US009303607B2

(12) United States Patent
Zeng et al.

(10) Patent No.: US 9,303,607 B2
(45) Date of Patent: Apr. 5, 2016

(54) FUEL PUMP WITH QUIET CAM OPERATED SUCTION VALVE

(75) Inventors: Paul Zeng, Inkster, MI (US); Vince Paul Solferino, Dearborn, MI (US); Kyi Shiah, Northville, MI (US); Joseph Basmaji, Waterford, MI (US); Patrick Brostrom, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 855 days.

(21) Appl. No.: 13/399,713

(22) Filed: Feb. 17, 2012

(65) Prior Publication Data

US 2013/0213359 A1 Aug. 22, 2013

(51) Int. Cl.
*F02M 59/36* (2006.01)
*F02M 63/02* (2006.01)

(52) U.S. Cl.
CPC ..... *F02M 59/361* (2013.01); *F02M 63/0265* (2013.01); *F02M 2200/09* (2013.01)

(58) Field of Classification Search
CPC ..... F02M 2200/09; F02M 59/361; F02M 63/0265
USPC ..... 123/445–447, 456–458, 462, 495, 496, 123/500–504, 508; 417/289, 317, 380, 571; 239/129.11–129.13, 309–312
See application file for complete search history.

(56) References Cited

U.S. PATENT DOCUMENTS

| | | | | |
|---|---|---|---|---|
| 1,149,892 | A | 8/1915 | Blattner | |
| 2,553,655 | A | 5/1951 | Herman et al. | |
| 2,621,524 | A | 12/1952 | Bretschneider | |
| 2,766,962 | A * | 10/1956 | Fodor et al. | 251/310 |
| 3,219,020 | A * | 11/1965 | Roosa | 123/387 |
| 3,227,311 | A * | 1/1966 | Rowell | 222/52 |
| 3,797,469 | A * | 3/1974 | Kobayashi et al. | 123/357 |
| 4,339,737 | A | 7/1982 | Meyers et al. | |
| 4,502,445 | A * | 3/1985 | Roca-Nierga et al. | 123/458 |
| 4,662,337 | A * | 5/1987 | Eheim | 123/450 |
| 4,667,641 | A * | 5/1987 | Djordjevic | 123/502 |
| 4,747,429 | A * | 5/1988 | Sundstrom, Jr. | 137/351 |
| 4,813,601 | A * | 3/1989 | Schwerdt et al. | 239/91 |
| 5,191,863 | A | 3/1993 | Hagiwara | |
| 5,385,540 | A | 1/1995 | Abbott et al. | |

(Continued)

FOREIGN PATENT DOCUMENTS

| | | |
|---|---|---|
| EP | 1013922 A2 | 6/2000 |
| EP | 1296061 A2 | 3/2003 |

(Continued)

OTHER PUBLICATIONS

Zeng, Paul et al., "Fuel Pump with Quiet Rotating Suction Valve," U.S. Appl. No. 13/399,842, filed Feb. 17, 2012, 48 pages.

(Continued)

*Primary Examiner* — Erick Solis
*Assistant Examiner* — Carl Staubach
(74) *Attorney, Agent, or Firm* — Julia Voutyras; Alleman Hall McCoy Russell & Tuttle LLP

(57) ABSTRACT

A fuel system including a high pressure fuel pump with a quiet fuel metering valve is disclosed. In one example, the quiet fuel metering valve may be cam driven. The fuel system may reduce engine noise and may provide operating modes that are different from other fuel systems.

18 Claims, 9 Drawing Sheets

(56) References Cited

U.S. PATENT DOCUMENTS

| | | | | |
|---|---|---|---|---|
| 5,570,870 | A | 11/1996 | Bilgery | |
| 5,671,717 | A * | 9/1997 | Rembold et al. | 123/495 |
| 5,678,521 | A * | 10/1997 | Thompson et al. | 123/447 |
| 5,772,182 | A | 6/1998 | Stambaugh et al. | |
| 5,900,148 | A * | 5/1999 | Izutani et al. | 210/416.4 |
| 5,979,414 | A * | 11/1999 | Pugh | 123/504 |
| 6,010,301 | A * | 1/2000 | Oi et al. | 415/55.2 |
| 6,119,829 | A * | 9/2000 | Nakadate | 188/266.6 |
| 6,145,540 | A | 11/2000 | Linkner | |
| 6,162,028 | A * | 12/2000 | Rembold | 417/413.1 |
| 6,296,197 | B1 * | 10/2001 | Boecking | 239/88 |
| 6,307,277 | B1 * | 10/2001 | Tamai et al. | 290/40 C |
| 6,314,945 | B1 * | 11/2001 | Sugiyama et al. | 123/506 |
| 6,408,823 | B1 * | 6/2002 | Takahashi et al. | 123/456 |
| 6,666,458 | B2 | 12/2003 | Coates | |
| 7,073,775 | B2 | 7/2006 | Kabir et al. | |
| 7,350,505 | B2 * | 4/2008 | Felton | 123/446 |
| 7,610,902 | B2 | 11/2009 | Beardmore et al. | |
| 8,006,952 | B2 | 8/2011 | Wygnanski | |
| 2002/0066276 | A1 | 6/2002 | Kawano et al. | |
| 2002/0148443 | A1 * | 10/2002 | Kojima | 123/446 |
| 2003/0026685 | A1 * | 2/2003 | Takagi et al. | 415/55.1 |
| 2003/0131732 | A1 | 7/2003 | Kim | |
| 2004/0091377 | A1 * | 5/2004 | Uryu et al. | 417/470 |
| 2006/0169803 | A1 * | 8/2006 | Kanamori | 239/533.3 |
| 2006/0249123 | A1 * | 11/2006 | Sandhu et al. | 123/508 |
| 2008/0085199 | A1 * | 4/2008 | Hazama et al. | 417/423.3 |
| 2008/0236193 | A1 | 10/2008 | Chen | |
| 2009/0126688 | A1 | 5/2009 | Borg et al. | |
| 2009/0241908 | A1 | 10/2009 | Tokuo et al. | |
| 2010/0139624 | A1 | 6/2010 | Surnilla et al. | |
| 2011/0097228 | A1 | 4/2011 | Tokuo et al. | |
| 2011/0217186 | A1 * | 9/2011 | Yoshizawa et al. | 417/295 |
| 2012/0324905 | A1 * | 12/2012 | Hagshenas | 60/778 |
| 2013/0213360 | A1 * | 8/2013 | Zeng et al. | 123/446 |
| 2013/0213361 | A1 * | 8/2013 | Zeng et al. | 123/446 |

FOREIGN PATENT DOCUMENTS

| | | | | |
|---|---|---|---|---|
| EP | 1701031 | A1 | 9/2006 | |
| JP | 401045928 | A * | 2/1989 | 123/472 |
| JP | 2007002954 | A | 1/2007 | |
| JP | 2010168901 | A | 8/2010 | |

OTHER PUBLICATIONS

Zeng, Paul et al., "Fuel Pump with Quiet Volume Control Operated Suction Valve," U.S. Appl. No. 13/399,897, filed Feb. 17, 2012, 47 pages.

* cited by examiner

FUEL PUMP WITH QUIET CAM OPERATED SUCTION VALVE

FIELD

The present description relates to a high pressure fuel pump for supplying fuel to an internal combustion engine. The high pressure fuel pump may be particularly useful for engines that include fuel injectors that inject fuel directly into engine cylinders.

BACKGROUND AND SUMMARY

Diesel and direct injection gasoline engines have fuel injection systems that directly inject fuel into engine cylinders. The fuel is injected to an engine cylinder at a higher pressure so that fuel can enter the cylinder during the compression stroke when cylinder pressure is higher. The fuel is elevated to the higher pressure by a mechanically driven fuel pump. Fuel pressure at the outlet of the fuel pump is controlled by adjusting an amount of fuel that flows through the fuel pump. One way to control flow through the fuel pump is via a solenoid operated metering valve. In one example, the solenoid is operated to close the metering valve during a pumping phase of the fuel pump. Closing the metering valve prevents fuel from flowing into or out of an inlet of the fuel pump. The closing time of the metering valve may be adjusted to control flow through the fuel pump. However, when the solenoid changes state to allow the metering valve to open or close, the solenoid or a portion of metering valve impacts a surface within the metering valve housing. The impact can produce a ticking sound that may not be desirable.

The inventors herein have recognized the above-mentioned disadvantages and have developed a fuel system, comprising: a cam driven fuel pump including an inlet and an outlet; a fuel injector in fluidic communication with the outlet; and a cam driven metering valve positioned at the inlet of the cam driven fuel pump.

By operating the metering valve via a cam, it may be possible to reduce the impact velocity between a metering valve and housing. As a result, a cam that operates the metering valve can be rotated with very little noise. Additionally, the cam operated metering valve can open without producing a striking noise. Consequently, both metering valve opening and closing noises may be reduced as compared to a solenoid operated metering valve.

The present description may provide several advantages. Specifically, the approach may reduce fuel system noise. Further, the approach may provide for improved fuel pressure control. Further still, the approach may improve metering valve durability by reducing impact forces between metering valve components.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an example, referred to herein as the Detailed Description, when taken alone or with reference to the drawings, where.

DETAILED DESCRIPTION

Figure 1:
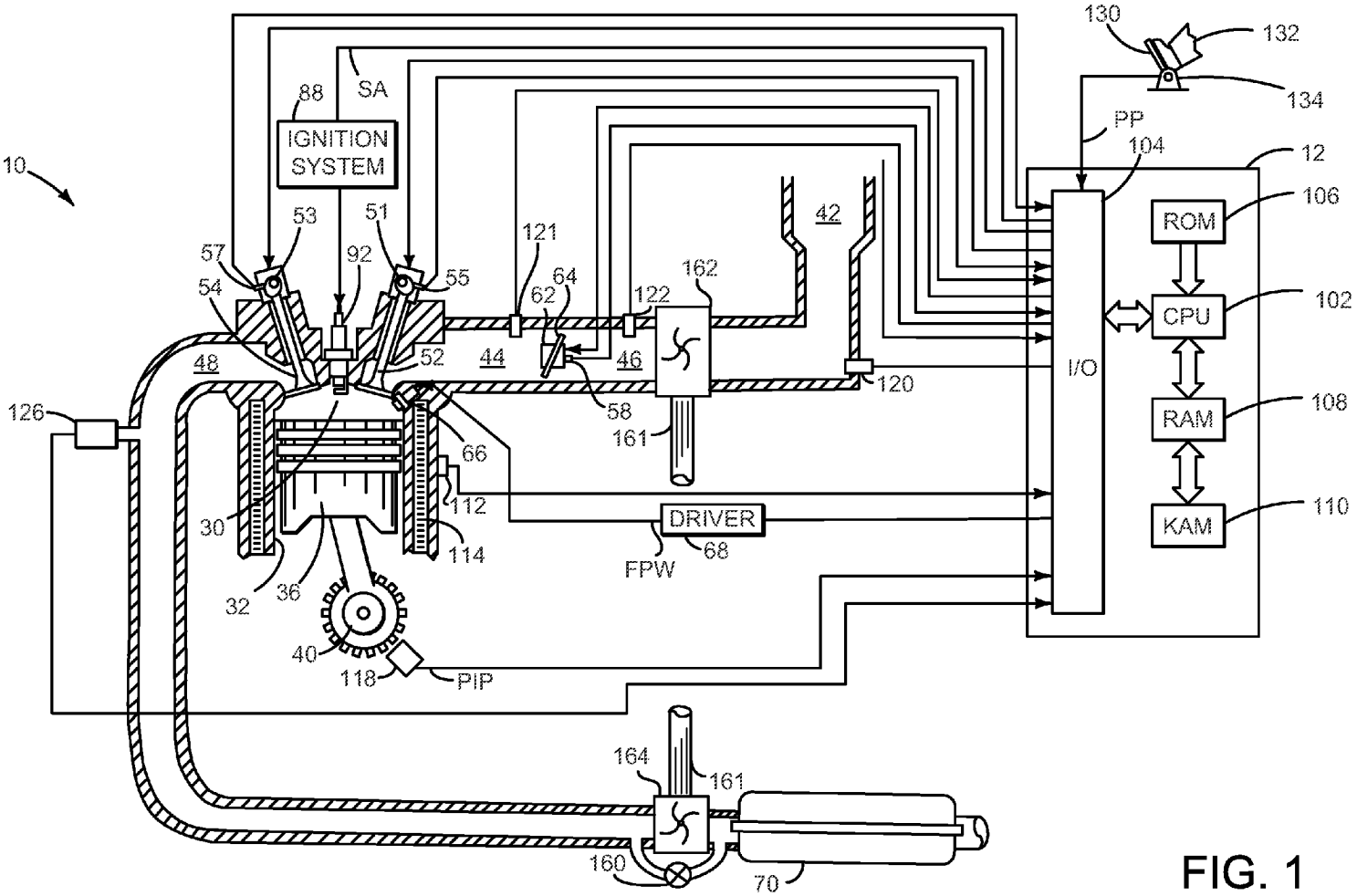
FIG. 1 is a schematic diagram of an example engine.
Figure 2:
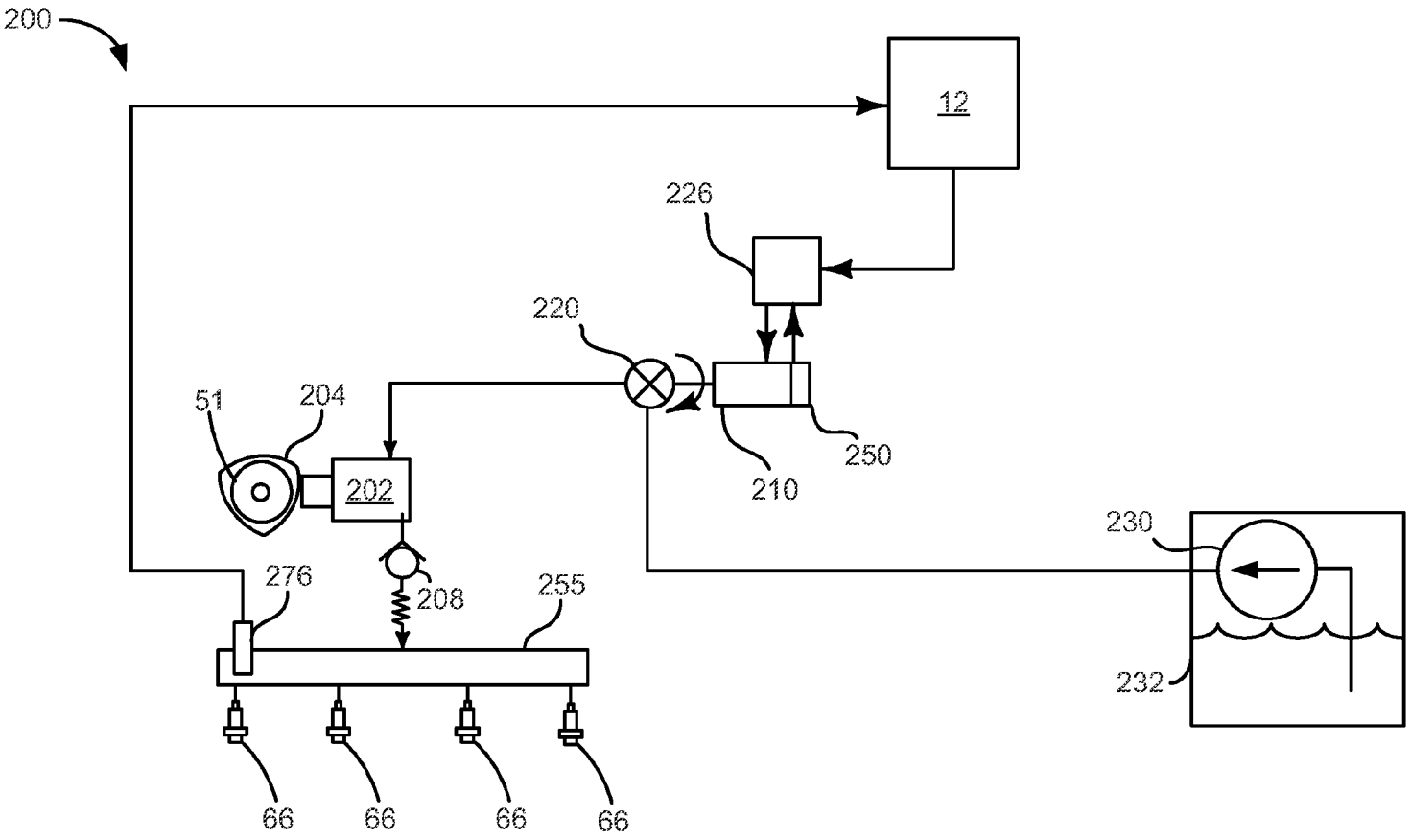
FIG. 2 is a schematic diagram of an example fuel system for an engine.

The present description is related to a fuel system for directly injecting fuel into cylinders of an engine. FIG. 1 shows an example direct injection gasoline engine. However, the fuel system described herein is equally applicable to diesel engines. FIG. 2 shows schematic of an example fuel system including a fuel pump and metering valve.

Figure 3A:
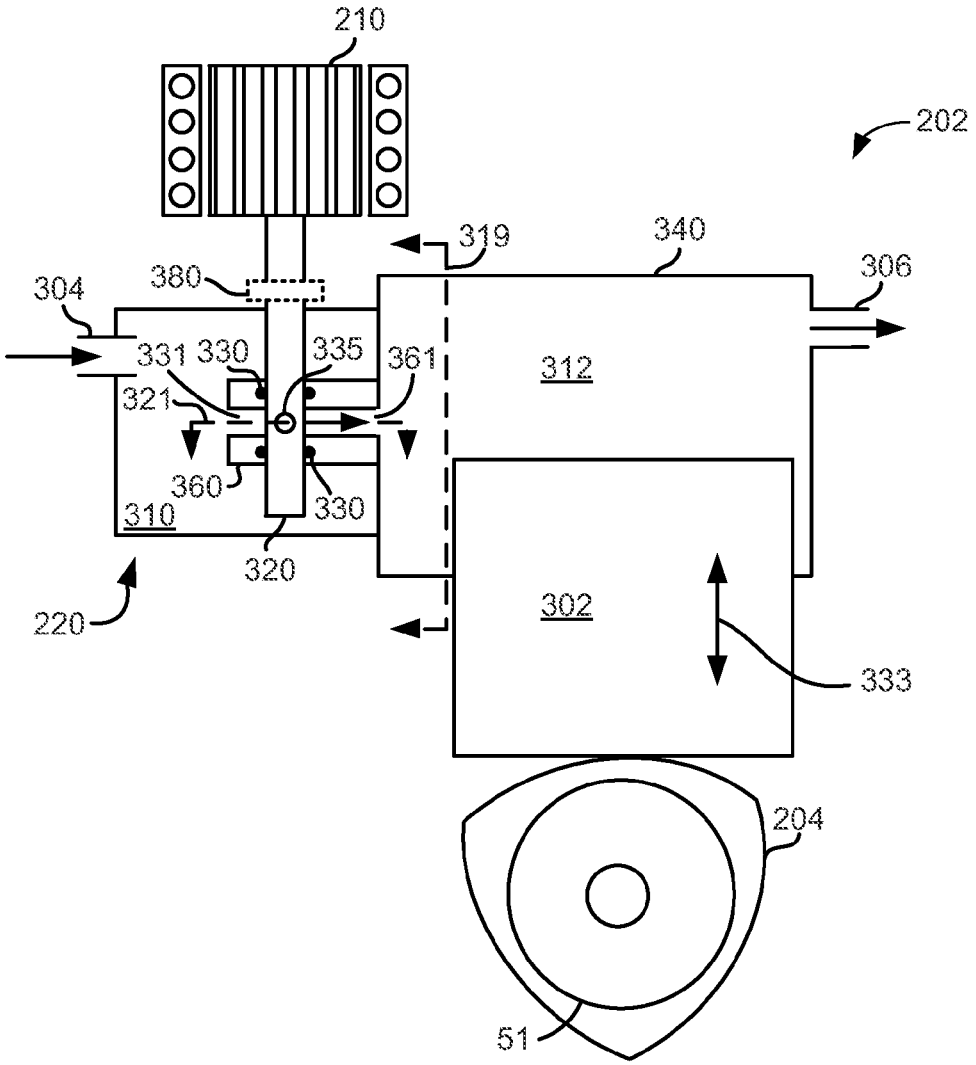
FIGS. 3A-3C show schematic diagrams of an example high pressure fuel pump and metering valve.
Figure 3B:
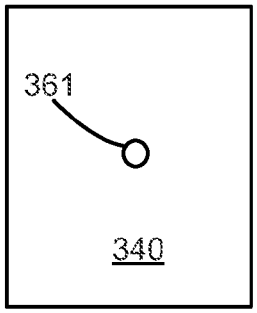
Figure 3C:
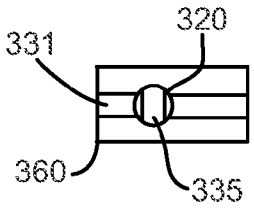
Figure 4A:
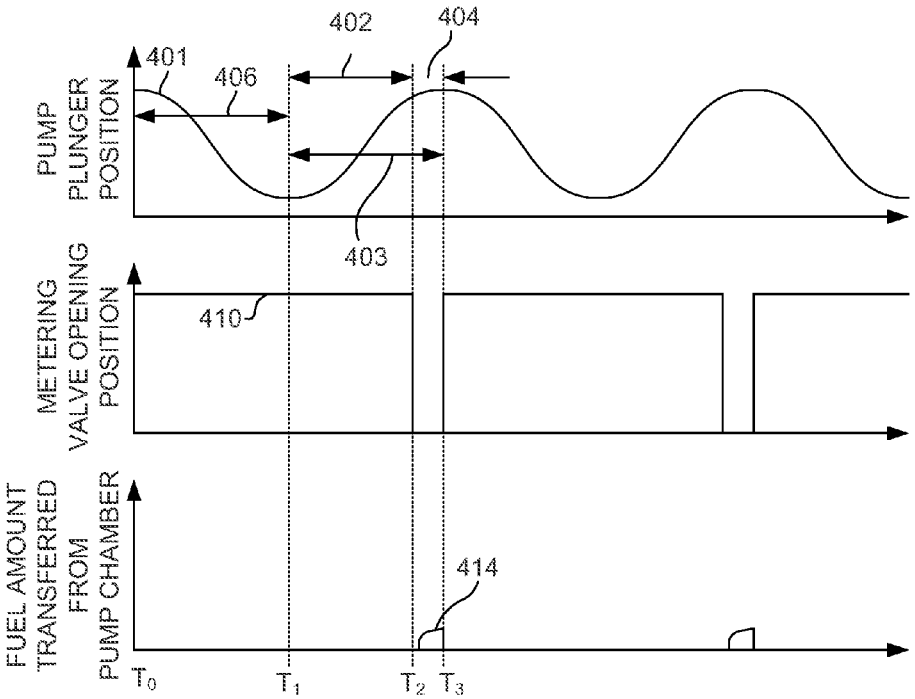
FIGS. 4A-4B show example plots of fuel pump and metering valve operating sequences.
Figure 4B:
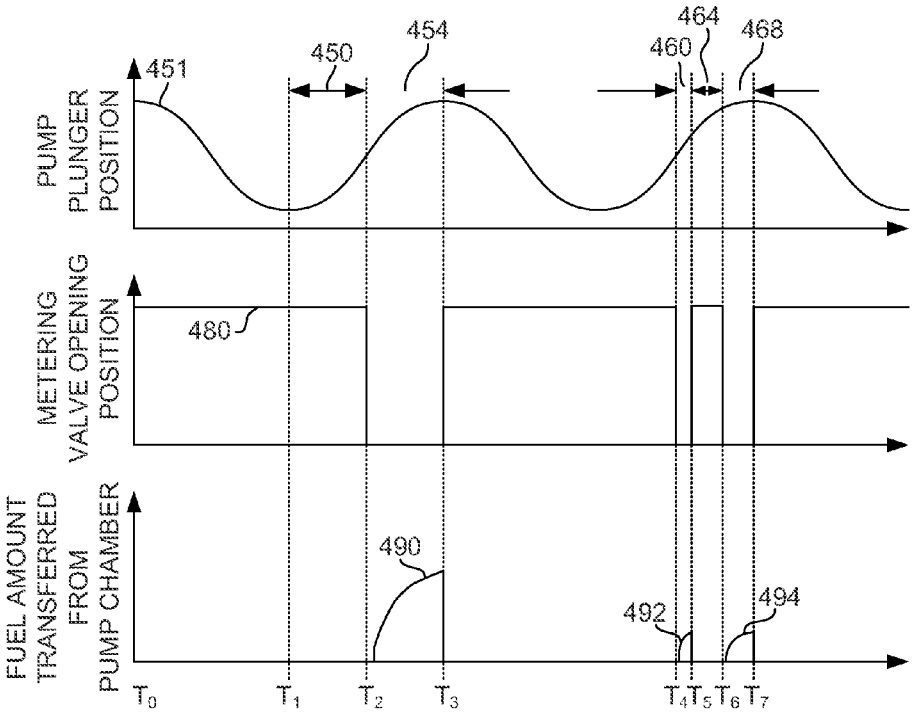
Figure 5A:
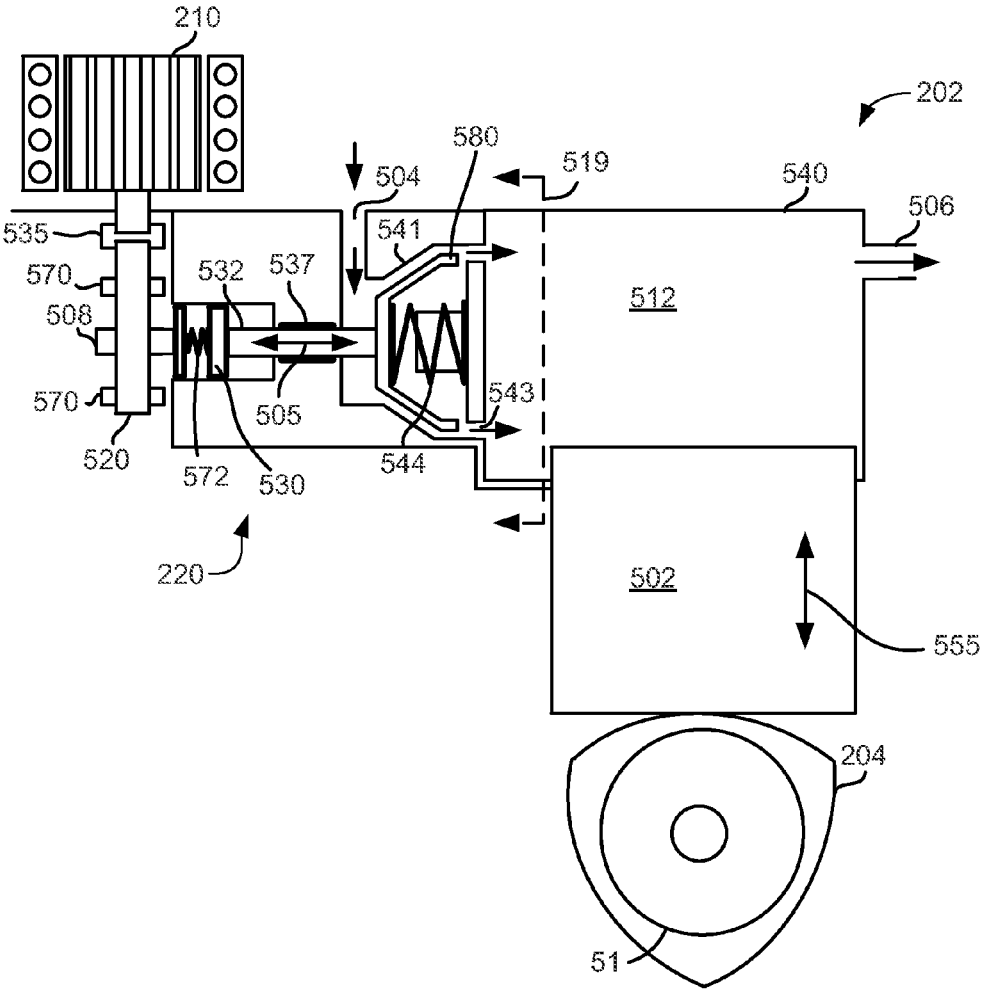
FIGS. 5A-5B show schematic diagrams of an example high pressure fuel pump and metering valve.
Figure 5B:
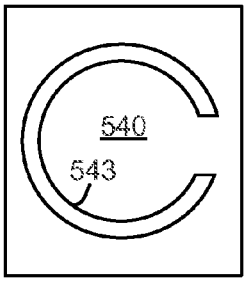
Figure 6A:
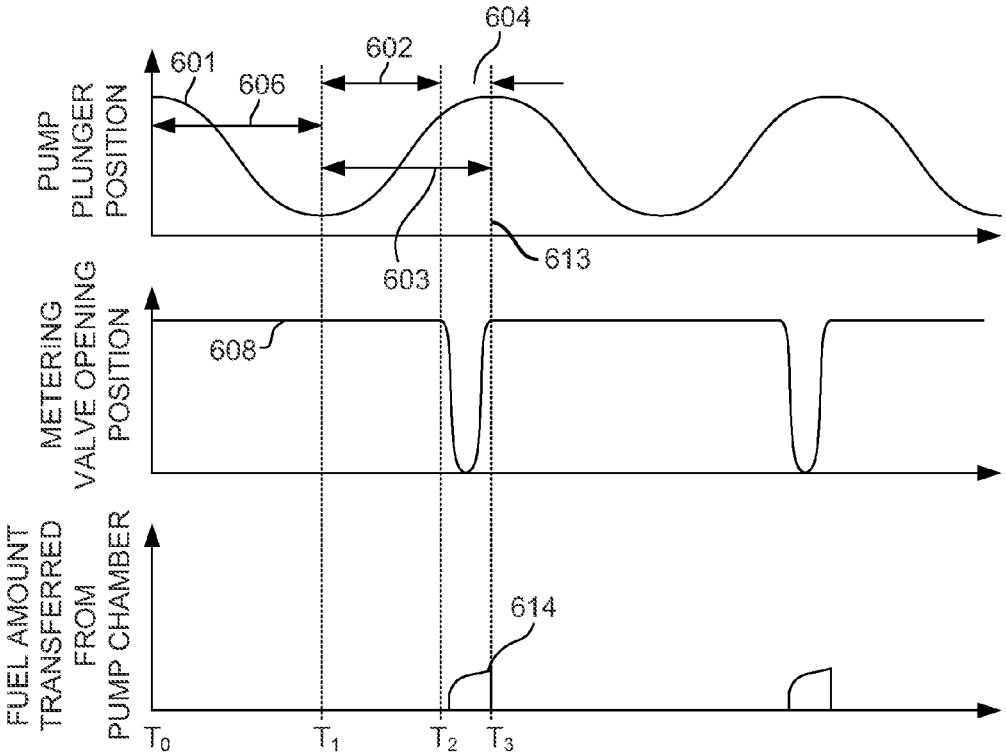
FIGS. 6A-6B show example plots of fuel pump and metering valve operating sequences.
Figure 6B:
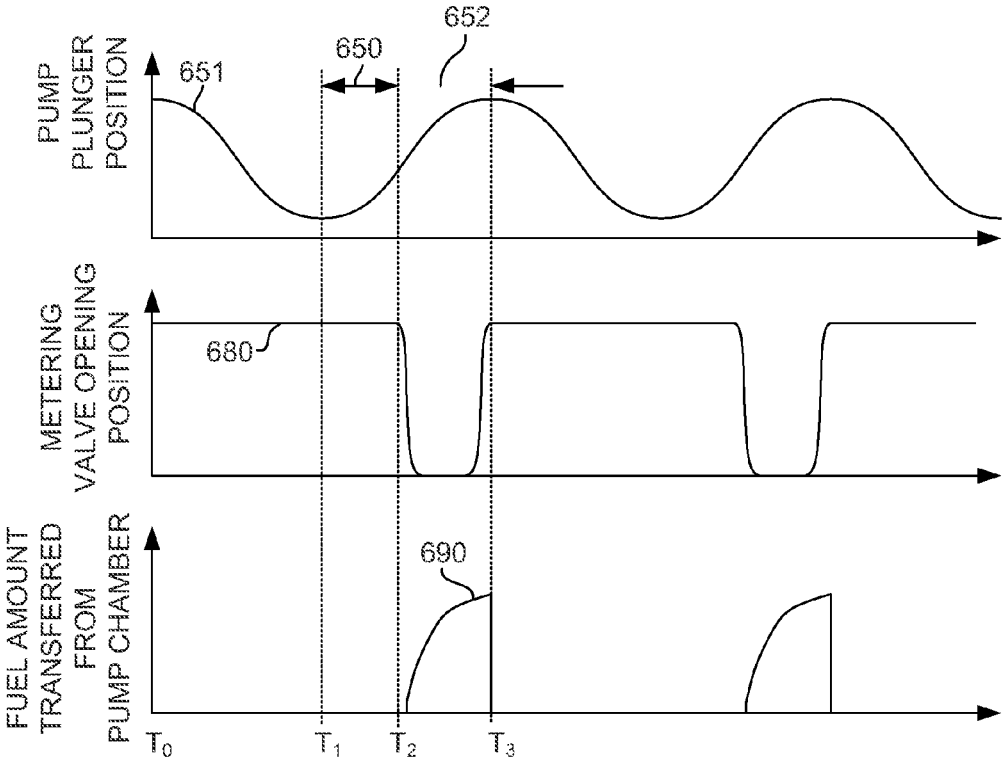

FIGS. 3A-3C show one example fuel pump and metering valve. FIGS. 4A-4B show example sequences for operating the fuel pump and metering valve shown in FIGS. 3A-3C. An alternative fuel pump and metering valve are shown in FIGS. 5A-5B. FIGS. 6A-6B show example sequences for operating the fuel pump and metering valve shown in FIGS. 5A-5B. Another alternative fuel pump and metering valve are shown in FIGS. 7A-7D. FIGS. 8A-8B show example sequences for operating the fuel pump and metering valve shown in FIGS. 7A-7D. The fuel pumps and metering valves described in FIGS. 2-8 may be operated according to the method of FIG. 9.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Compressor 162 draws air from air intake 42 to supply boost chamber 46. Exhaust gases spin turbine 164 which is coupled to compressor 162 via shaft 161. Vacuum operated waste gate actuator 160 allows exhaust gases to bypass turbine 164 so that boost pressure can be controlled under varying operating conditions.

Fuel injector 66 is shown positioned to inject fuel directly into combustion chamber 30, which is known to those skilled in the art as direct injection. Alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (See FIG. 2) including a fuel tank, fuel pump, and fuel rail. Fuel injector 66 is supplied operating current from driver 68 which responds to controller 12. In addition, intake manifold 44 is shown communicating with optional electronic throttle 62 which adjusts a position of throttle plate 64 to control air flow from air intake 42 to intake manifold 44.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 121 coupled to intake manifold 44; boost chamber pressure from pressure sensor 122; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. The hybrid vehicle may have a parallel configuration, series configuration, or variation or combinations thereof. Further, in some examples, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Referring now to FIG. 2, an example fuel system is shown. Fuel system 200 includes a controller 12 that receives fuel pressure information via fuel pressure sensor 276. Controller 12 supplies metering valve opening and closing timing commands to motor controller 226. In some examples, motor controller 226 may be integrated into controller 12. Controller 12 also receives engine camshaft and crankshaft position information as is shown in FIG. 1. Motor controller 226 receives motor position information from encoder 250 which is mechanically coupled to motor 210. Motor controller 226 supplies current to windings of motor 210. In one example, motor 210 is a 3-phase stepper motor. Motor 210 rotates to allow fuel to selectively flow though high pressure fuel pump metering valve 220.

Low pressure fuel pump 230 transfers fuel from fuel tank 232 to fuel metering valve 220. Fuel may flow from high pressure fuel pump metering valve 220 to high pressure fuel pump 202 when high pressure fuel pump metering valve 220 is positioned to allow fuel to flow through high pressure fuel pump 202. High pressure fuel pump is driven by lobe 204 which is included with cam 51. In particular, lobe 204 moves a piston or plunger to pressurize fuel in the high pressure fuel pump 202. Check valve 208 is biased to allow fuel to flow from the outlet of fuel pump 202 but to limit flow into the outlet of fuel pump 202. Check valve 208 allows fuel to flow into fuel rail 255 which supplies fuel to one or more fuel injectors 66. Fuel injectors 66 may be opened and closed according to commands issued by controller 12.

Referring now to FIG. 3A, a cross section of a first example of high pressure fuel pump 202 and high pressure fuel pump metering valve 220 is shown. The high pressure fuel pump and high pressure fuel pump metering valve shown in FIG. 3A may supply fuel to the engine shown in FIG. 1 as part of the fuel system shown in FIG. 2. The high pressure fuel pump and high pressure fuel pump metering valve shown in FIG. 3A may be operated according to the method of FIG. 9.

High pressure fuel pump 202 includes a housing 340, a plunger 302, and a pump chamber 312. Plunger 302 reciprocates in the directions indicated at 333 when cam lobe 204 applies force to plunger 302. Cam lobe 204 rotates with camshaft 51 which rotates as the engine rotates. Camshaft 51 rotates at one half of crankshaft speed. When camshaft 51 rotates to a position where a maximum lift (e.g., any one of the peaks of lobe 204) of lobe 204 is in contact with plunger 302, plunger 302 is positioned in pump chamber 312 such that the unoccupied volume in pump chamber 312 is at a minimum value. When camshaft 51 rotates to a position where a minimum lift (e.g., any one of the low sections of lobe 204) of lobe 204 is in contact with plunger 302, plunger 302 is positioned in pump chamber 312 (e.g., the region where fuel may be pressurized in the high pressure fuel pump 202) such that the volume of pump chamber 312 is at a maximum value. Thus, when fuel is present in pump chamber 312 while metering valve 220 is closed, fuel pressure can be increased within fuel pump 202 by decreasing the volume of pump chamber 312.

Fuel may enter or exit pump chamber 312 via pump chamber inlet 361. Fuel may exit pump chamber 312 via pump chamber outlet 306. Cutting plane 319 defines the cross section shown in FIG. 3B. Cutting plane 321 defines the cross section shown in FIG. 3C. Fuel leaves pump chamber 312 when fuel pressure within pump chamber 312 exceeds fuel pressure behind a check valve at the pump chamber outlet 306. Fuel may also leave pump chamber 312 when high pressure fuel pump metering valve 220 is open during a pumping phase of high pressure fuel pump 202.

High pressure fuel pump metering valve 220 includes shaft 320 which may be rotated via motor 210. Shaft 320 includes orifice 335 that may allow fuel to flow into chamber 312 when shaft 320 is properly position. Shaft 320 and orifice 335 are shown in a closed position whereby fuel flow into and out of pump chamber 312 is substantially stopped. Shaft 320 rotates to selectively allow fuel to flow from metering valve chamber 310 and valve body 360 into pump chamber 312. Valve body 360 includes passage 331 through which fuel may flow into pump chamber 312. Seals 330 provide a seal between shaft 320 and valve body 360. Fuel flows in the direction of the arrows. However, if orifice 335 is in an open position when plunger 302 starts an upward stroke, fuel may flow from pump chamber 312 to metering valve chamber 310 via orifice 335.

Metering valve chamber 310 includes an inlet 304 for receiving fuel from a low pressure fuel pump. Shaft 320 pierces metering valve chamber 310 in the present example. However, in other examples, shaft 320 and motor 210 may be within metering valve chamber 310. Further, motor 210 is shown coupled to shaft 320 via optional flex coupling 380.

Referring now to FIG. 3B, a section of fuel pump 202 indicated by cutting plane 319 of FIG. 3A is shown. Housing 340 includes inlet 361 which is in communication with passage 331 of valve body 360. Thus, fuel may flow through passage 331 and through passage 361 before entering pump chamber 312.

Referring now to FIG. 3C, a section of high pressure fuel pump metering valve 220 which is indicated by cutting plane 321 of FIG. 3A is shown. Valve body 360 includes passage 331 passing through its length. Shaft 320 includes orifice 335. Orifice 335 is shown positioned perpendicular to passage 331 such that passage 331 is closed by shaft 320. Passage 331 is opened when shaft 320 is rotated 90 degrees. Thus, by rotating shaft 320 via motor 210, passage 331 may be selectively opened and closed. Further, passage 331 may be opened and closed independent of the position of plunger 302 shown in FIG. 3A. In this way, shaft 320 can seal and unseal passage 311 via rotation to allow or inhibit fuel flow from metering valve chamber 310 to pump chamber 312.

Referring now to FIG. 4A, it shows several plots of interest during operation of high pressure fuel pump 202 and high pressure fuel pump metering valve 220 shown in FIG. 3A. The sequence of FIG. 4A may be performed on the system as shown in FIGS. 1-3C according to the method of FIG. 9. Vertical time markers $T_0$-$T_3$ represent particular times of interest during the sequence. The events shown in one plot at a particular time marker occur at the same time as events in the other plots that align with the same time marker.

The first plot from the top of FIG. 4A represents high pressure fuel pump plunger position (e.g., 302 of FIG. 3A). The X axis represents time and time increases from the left to the right side of the figure. The Y axis represents pump plunger position and pumping chamber volume is lowest when the plunger position trace 401 is at its highest value in the direction of the Y axis arrow.

The second plot from the top of FIG. 4A represents high pressure fuel pump metering valve state. The Y axis represents high pressure fuel pump metering valve position. The X axis represents time and time increases from the left side of the plot to right side of the plot. The high pressure fuel pump metering valve is open when high pressure fuel pump metering valve position 410 is at a higher level. The high pressure fuel pump metering valve is closed when high pressure fuel pump metering valve position 410 is near the X axis.

The third plot from the top of FIG. 4A represents fuel amount transferred from the high pressure fuel pump to the engine fuel rail. The Y axis represents the amount of fuel transferred from the high pressure fuel pump to the fuel rail and the amount increases in the direction of the Y axis arrow. The X axis represents time and time increases from the left side of the plot to the right side of the plot.

High pressure fuel pump plunger position 401 is shown with a sinusoidal trajectory. The high pressure fuel pump plunger extends and retracts into the pump chamber as a camshaft rotates a cam lobe. The high pressure pump suction phase is shown as the region 406. The pumping phase is shown as region 403. During the suction phase, the plunger moves in a direction to increase volume in the pump chamber 312. The pressure in the pump chamber 312 may decrease as the pump chamber volume increases. During the pumping phase, the plunger moves in a direction to decrease volume in the pump chamber. The fuel pressure in the pump chamber 312 may increase as the pump chamber volume decreases.

In this example, at time $T_0$, the pump plunger starts at a higher level and decreases with time such that the high pressure fuel pump is in a suction phase. The high pressure fuel pump metering valve is open during suction phase 406 and no fuel is supplied to the fuel rail. The high pressure fuel pump metering valve position 410 remains in an open state to allow fuel to flow out of the pump chamber 312 as the plunger enters the pumping phase in region 403. The pumping phase begins at time $T_1$. During spill phase in region 402, fuel in pump chamber 312 is pushed into the metering valve chamber 310 since high pressure fuel pump metering valve 220 is in an open state and since the volume of pump chamber 312 is decreasing. A cycle of the high pressure pump includes one spill phase and one pumping phase.

At time $T_2$, the metering valve closes as indicated by the metering valve opening position transitioning to zero. The spill phase in region 402 is ended and output phase in region 404 begins in response to closing the high pressure fuel pump metering valve. Fuel exits high pressure fuel pump 202 during the output phase when fuel pressure in pump chamber 312 increases above fuel pressure in the fuel rail. The amount of fuel output is shown at 414 and is relatively small as the metering valve is closed late in the pumping phase. A new suction phase and cycle of the high pressure fuel pump begins at time $T_3$.

The amount of fuel pumped and the fuel pressure provided to the fuel rail may be increased by advancing the high pressure fuel pump metering valve closing timing during the pumping phase. The amount of fuel pumped and the fuel pressure provided to the fuel rail may be decreased by retarding the high pressure fuel pump metering valve closing timing during the pumping phase. The high pressure fuel pump metering valve closing is advanced when the high pressure fuel pump metering valve is closed earlier in the pumping phase. The high pressure fuel pump metering valve closing is retarded when the high pressure fuel pump metering valve is closed later in the pumping phase.

Referring now to FIG. 4B, a second operating sequence of high pressure fuel pump 202 and high pressure fuel pump metering valve 220 shown in FIG. 3A is provided. The sequence of FIG. 4B may be performed on the system as shown in FIGS. 1-3C according to the method of FIG. 9. The plots of FIG. 4B are similar to the plots of FIG. 4A. Therefore, description of similar features and elements are omitted for the sake of brevity. Particular differences are described.

At time $T_0$, the high pressure fuel pump plunger position 451 is decreasing indicating that the high pressure fuel pump is in a suction phase. The high pressure fuel pump metering valve position 480 is shown open position to allow fuel to flow into the high pressure fuel pump chamber 312. No fuel is transferred from the high pressure fuel pump to the fuel rail.

At time $T_1$, the high pressure fuel pump plunger position begins the pumping phase which extends from time $T_1$ to time $T_3$. The metering valve is open from time $T_1$ to time $T_2$. Therefore, the high pressure fuel pump is in a spill phase in region 450. The metering valve closes at time $T_2$ and plunger 302 begins to pressurize fuel in pump chamber 312. Since high pressure fuel pump metering valve position 451 is closed, the high pressure fuel pump is in an output phase as indicated by region 454. It should be noted that metering valve 220 is closed at time $T_2$ which is advanced of the metering valve closing time illustrated in FIG. 4A. Thus, a larger volume of pump chamber 312 is displaced after metering valve closing timing shown in FIG. 4B between time $T_2$ and time $T_3$ as compared to that shown between time $T_2$ and time $T_3$ in FIG. 4A. Further, time $T_2$ in FIG. 4B is advanced as compared to time $T_2$ in FIG. 4A. As a result, the fuel amount transferred from the high pressure pump increases as shown at 490.

After time $T_3$, the high pressure fuel pump enters a suction phase once again and then enters a pumping phase as the plunger position transitions from decreasing to increasing. The high pressure fuel pump metering valve is open during the suction phase and part way through the pumping phase.

At time $T_4$, the high pressure fuel pump metering valve is closed and a small amount of fuel is transferred from the high pressure fuel pump to the engine fuel rail. Shortly thereafter at time $T_5$, the high pressure fuel pump metering valve is opened again. Thus, fuel is output from the high pressure fuel pump in region 460 while fuel flow from the fuel pump to the fuel rail is stopped in region 464. The high pressure fuel pump metering valve is closed again at time $T_6$ and fuel starts flowing to from the high pressure fuel pump to the fuel rail. Thus, fuel flows from the high pressure fuel pump to the fuel rail in region 468. The high pressure fuel pump metering valve is reopened at time $T_7$ where the suction phase starts.

The amount of fuel pumped from the high pressure fuel pump during region 460 is shown at 492. The amount of fuel pumped from the high pressure fuel pump during region 468 is shown at 494. Plunger 302 moves about a same vertical distance in region 460 and region 468 even though region 468 is longer in time duration than region 460. This is a characteristic of the sinusoidal plunger trajectory. Thus, the high pressure fuel pump metering valve may be opened and closed a plurality of times during a pumping phase of a high pressure fuel pump. In one example, the high pressure fuel pump metering valve may be opened and closed in response to fuel pressure sensed at a fuel rail. Thus, small adjustments may be made to fuel rail pressure via adjusting high pressure fuel pump metering valve opening and closing timings. High pressure fuel pump metering valve 320 may be opened and closed independent of the position of plunger 302. However, it is desirable to keep metering valve 320 open during the suction phase of high pressure fuel pump 202 to improve pump efficiency and to reduce fuel aeration.

Referring now to FIG. 5A, a cross section of an alternative example high pressure fuel pump 202 and high pressure fuel pump metering valve 220 is shown. The fuel pump and high pressure fuel pump metering valve shown in FIG. 5A may supply fuel to the engine shown in FIG. 1 as part of the fuel system shown in FIG. 2. The fuel pump and high pressure fuel pump metering valve shown in FIG. 5A may be operated according to the method of FIG. 9.

High pressure fuel pump 202 includes a high pressure pump plunger 502 and a pump chamber 512. Pump chamber 512 is surrounded by fuel pump housing 540. Fuel may exit fuel pump chamber 512 via fuel pump outlet 506. Fuel pump outlet 506 supplies fuel to an engine fuel rail and fuel injectors. Pump plunger 502 reciprocates in the directions shown at 555. Cam 51 includes lobes 204 that apply force to pump plunger 502 when cam 51 is rotated.

Fuel enters fuel pump 202 via fuel inlet 504 in the direction indicated by the arrows. Fuel passes by valve disk 580 and through slot 543 in the direction shown by the arrows. Disk 580 is shown in an open position away or not in contact with valve seat 541. Disk 580 is in contact with valve seat 541 when metering valve 220 is closed. Spring 544 returns disk 580 to valve seat 541 when cam 508 is at a low lift state. Cutting plane 519 defines the cross section shown in FIG. 5B. Shaft 532 reciprocates in the directions indicated by arrow 505. Sealing ring 537 prevents fuel from flowing out of high pressure fuel pump 202. A tappet 530 may be positioned between cam 508 and shaft 505. Tappet 530 includes a spring 572.

Motor 210 may be coupled to shaft 520 via coupling 535 and oriented perpendicular to the axis of motion of pump plunger 502. Bearings 570 support shaft 520. Cam 508 supplies force to lift tappet 530 when shaft 520 is rotated by motor 210. Motor 210 may be rotated synchronously with cam 51 and movement of pump plunger 502. Further, the phase of rotation of motor 210 may be adjusted relative to the phase of rotation of cam 51 as shown in FIG. 6A-6B to adjust fuel pressure supplied to the fuel rail.

Referring now to FIG. 5B, a section of metering valve 220 indicated by cutting plane 519 of FIG. 5A is shown. Housing 540 includes slot or passage 543 which may allow fuel to flow into pump chamber 512.

Thus, the system of FIGS. 1-2 and 5A provides for a fuel system, comprising: a cam driven fuel pump including an inlet and an outlet; a fuel injector in fluidic communication with the outlet; and a cam driven metering valve positioned at the inlet of the cam driven fuel pump. The fuel system includes where the cam driven metering valve further comprises a valve seat and a valve disk. The fuel system also includes where the cam driven metering valve further comprises a return spring positioned to close the valve disk against the valve seat. The fuel system further includes where the valve disk is coupled to a shaft. The fuel system further comprises a cam, the cam in mechanical communication with the shaft. The fuel system further comprises a sealing ring, the sealing ring in mechanical communication with the shaft. The fuel system further comprises a check valve, the check valve positioned at the outlet and biased to prevent fuel flow into the outlet. In this way, operating noise of a high pressure fuel pump may be reduced.

The system of FIGS. 1-2 and 5A also provides for a fuel system comprising: a cam driven fuel pump including an inlet and an outlet; a fuel injector in fluidic communication with the outlet; a cam driven metering valve positioned at the inlet of the cam driven fuel pump; and a motor in mechanical communication with the cam driven metering valve. The fuel system further comprises a cam, the cam in mechanical communication with the motor. The fuel system further comprises a valve seat and a valve disk. The fuel system includes where the motor includes a motor shaft, and where the motor shaft is perpendicular to an axis of motion of the valve plunger. The fuel system includes where the valve plunger is away from the valve seat when the cam driven metering valve is in an open position, and where the valve plunger is in contact with the valve seat when the cam driven metering valve is in a closed position. The fuel system further comprises a spring, and where the spring is in mechanical communication with the valve disk. The fuel system includes where the spring is biased to close the valve disk against the valve seat.

In another example, the fuel system comprises: a cam driven fuel pump including an inlet, an outlet, and a plunger; a fuel injector in fluidic communication with the outlet; a cam driven metering valve positioned at the inlet of the cam driven fuel pump; a motor in mechanical communication with the cam driven metering valve; and a controller. The fuel system includes where the controller includes instructions stored in a non-transitory medium, the instructions providing for opening the cam driven metering valve when the plunger is substantially at a maximum plunger lift level. The fuel system also includes where the controller includes further instructions to closing timing of the cam driven metering valve in response to engine load. The fuel system further includes where the controller includes further instructions to rotate the motor synchronous with motion of the plunger. The fuel system also includes where the controller includes further instructions to adjust an amount of fuel output from the cam driven fuel pump. In one example, the fuel system includes where the controller includes further instructions to rotate the motor in response to fuel pressure in a fuel rail.

Referring now to FIG. 6A, it shows several plots of interest during operation of high pressure fuel pump 202 and high pressure fuel pump metering valve 220 shown in FIG. 5A. The sequence of FIG. 6A may be performed on the system as shown in FIGS. 1-2 and 5A-B according to the method of FIG. 9. Vertical time markers $T_0$-$T_3$ represent particular times of interest during the sequence. The events shown in one plot at a particular time marker occur at the same time as events in the other plots that align with the same time marker. The plots of FIG. 6A are similar to the plots of FIG. 4A. Therefore, description of similar features and elements are omitted for the sake of brevity. Particular differences are described.

High pressure fuel pump plunger position 601 is shown with a sinusoidal trajectory. The plunger extends and retracts into the pump chamber as camshaft 51 rotates a cam lobe 204. The high pressure pump suction phase is shown as the region 606. The pumping phase is shown as region 603. During the suction phase, the plunger moves in a direction to increase volume in the pump chamber 512. Pressure in the pump chamber 512 may decrease as the pump chamber volume increases. During the pumping phase, the plunger moves in a direction to decrease volume in the pump chamber. The pressure in the pump chamber 512 may increase as the pump chamber volume decreases.

In this example, at time $T_0$, the pump plunger starts at a higher level and decreases with time such that the high pressure fuel pump is in a suction phase. The high pressure fuel pump metering valve 220 is open during suction phase 606 and no fuel is supplied to the fuel rail. The high pressure fuel pump metering valve position 608 (e.g., position of disk 580) remains in an open state to allow fuel to flow out of the pump chamber 512 as the plunger enters the pumping phase in region 603. The pumping phase begins at time $T_1$. During spill phase in region 602, fuel in pump chamber 512 flows out since metering valve 220 is in an open state and since the volume of pump chamber 512 is decreasing.

At time $T_2$, the metering valve begins to close as indicated by the metering valve opening position transitioning toward zero. Since high pressure fuel pump metering valve 220 is cam driven in this example, the position of high pressure fuel pump metering valve 220 does not change as quickly as the high pressure fuel pump metering valve shown in FIG. 3A. Rather, the position of high pressure fuel pump metering valve 220 changes as the lift of cam 508 changes. And, the lift of cam 508 changes as the position of motor 210 changes. The velocity of disk 580 is also influenced by the lift and speed of rotation of cam 508. The lift of cam 508 decreases as disk 580 approaches seat 541 so that the velocity of disk 580 is near zero when disk 580 contacts seat 541. In this way, valve closing noise may be reduced. The spill phase in region 602 is ended and output phase in region 604 begins in response to closing the high pressure fuel pump metering valve 220. Fuel exits high pressure fuel pump 202 during the output phase when fuel pressure in pump chamber 512 increases above fuel pressure in the fuel rail. The amount of fuel output is shown at 614 and is relatively small as the high pressure fuel pump metering valve is closed late in the pumping phase.

The amount of fuel pumped and the fuel pressure provided to the fuel rail may be increased by advancing the high pressure fuel pump metering valve closing timing during the pumping phase. The amount of fuel pumped and the fuel pressure provided to the fuel rail may be decreased by retarding the high pressure fuel pump metering valve closing timing during the pumping phase. The high pressure fuel pump metering valve closing is advanced when the high pressure fuel pump metering valve is closed earlier in the pumping phase. The high pressure fuel pump metering valve closing is retarded when the high pressure fuel pump metering valve is closed later in the pumping phase.

Referring now to FIG. 6B, a second operating sequence of high pressure fuel pump 202 and high pressure fuel pump metering valve 220 shown in FIG. 5A is provided. The sequence of FIG. 6B may be performed on the system as shown in FIGS. 1-2 and 5A-B according to the method of FIG. 9. The plots of FIG. 6B are similar to the plots of FIG. 4A. Therefore, description of similar features and elements are omitted for the sake of brevity. Particular differences are described.

At time $T_0$, the high pressure fuel pump plunger position 651 is decreasing indicating that the high pressure fuel pump is in a suction phase. The high pressure fuel pump metering valve position 680 is shown open position to allow fuel to flow into the high pressure fuel pump chamber 512. No fuel is transferred from the high pressure fuel pump to the fuel rail.

At time $T_1$, the high pressure fuel pump plunger position begins the pumping phase which extends from time $T_1$ to time $T_3$. The high pressure fuel pump metering valve is open from time $T_1$ to time $T_2$. Therefore, the high pressure fuel pump is in a spill phase in region 650. The high pressure fuel pump metering valve begins to close at time $T_2$ and plunger 502 begins to pressurize fuel in pump chamber 512. The high pressure fuel pump is in an output phase between times $T_2$ and $T_3$ as indicated by region 652. It should be noted that high pressure fuel pump metering valve 220 begins to close at time $T_2$ which is advanced of the high pressure fuel pump metering valve closing time illustrated in FIG. 6A. Thus, a larger volume of pump chamber 512 is displaced after high pressure fuel pump metering valve closing timing shown in FIG. 6B between time $T_2$ and time $T_3$ as compared to that shown between time $T_2$ and time $T_3$ in FIG. 6A. Further, time $T_2$ in FIG. 6B is advanced as compared to time $T_2$ in FIG. 6A. As a result, the fuel amount transferred from the high pressure pump increases as shown at 690.

After time $T_3$, the high pressure fuel pump enters a suction phase once again and then enters a pumping phase as the plunger position transitions from decreasing to increasing. The high pressure fuel pump metering valve is open during the suction phase and part way through the pumping phase.

Figure 7A:
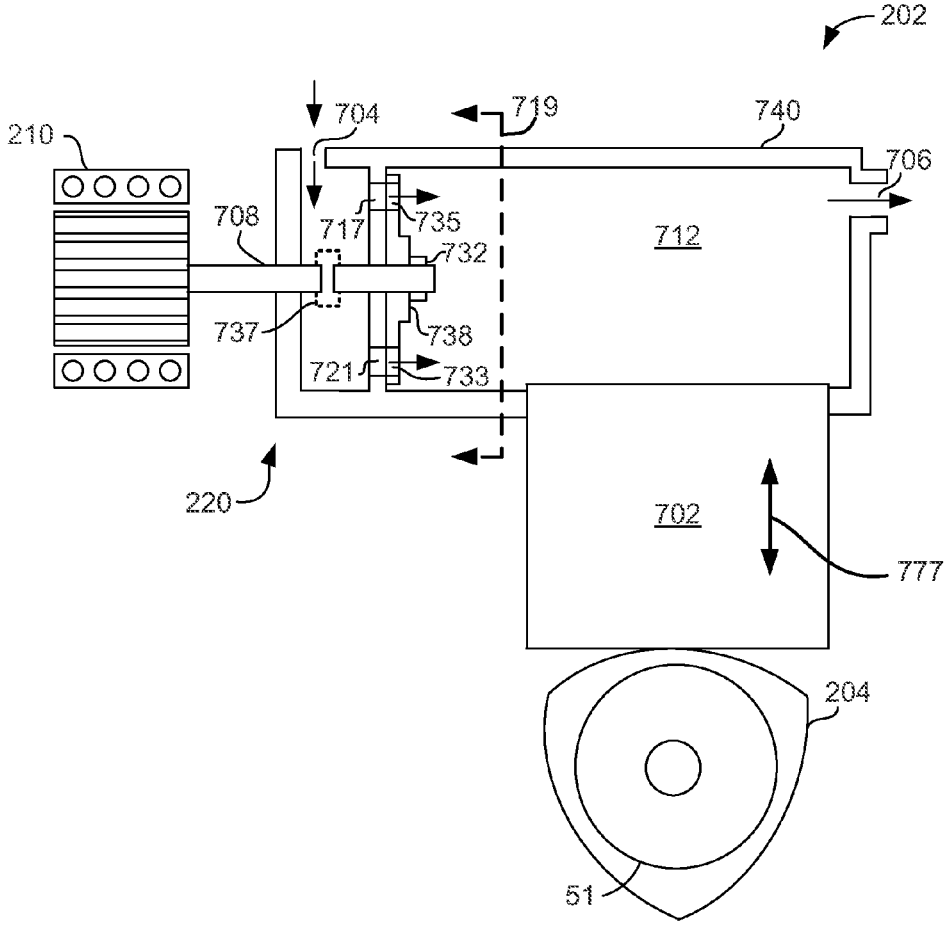
FIGS. 7A-7D show schematic diagrams of an example fuel pump and metering valve.
Figure 8A:
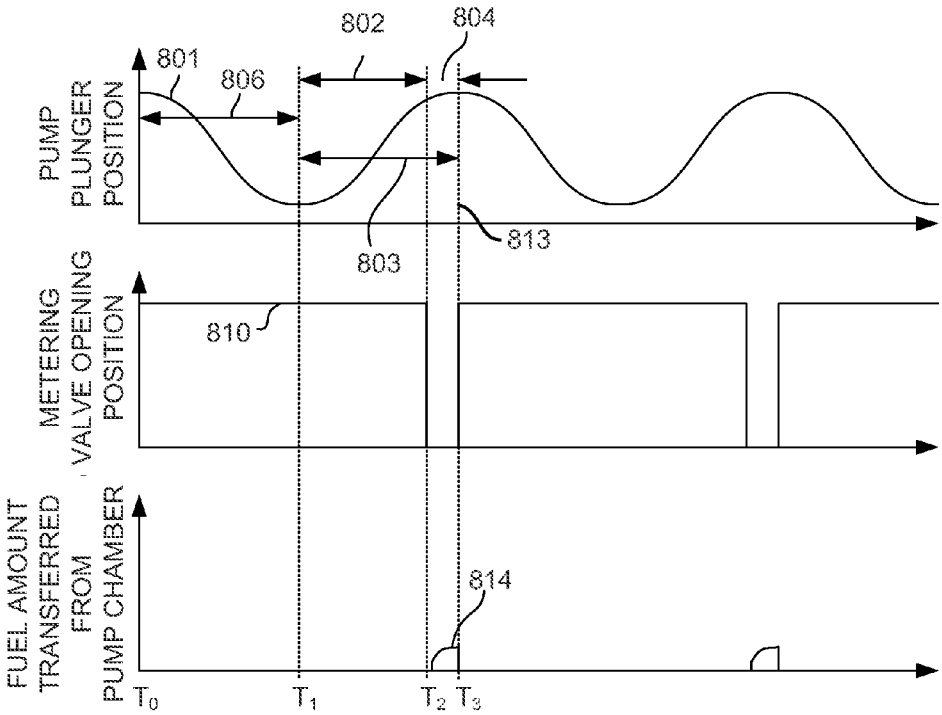
FIGS. 8A-8B are example plots of fuel pump and metering valve operating sequences.
Figure 8B:
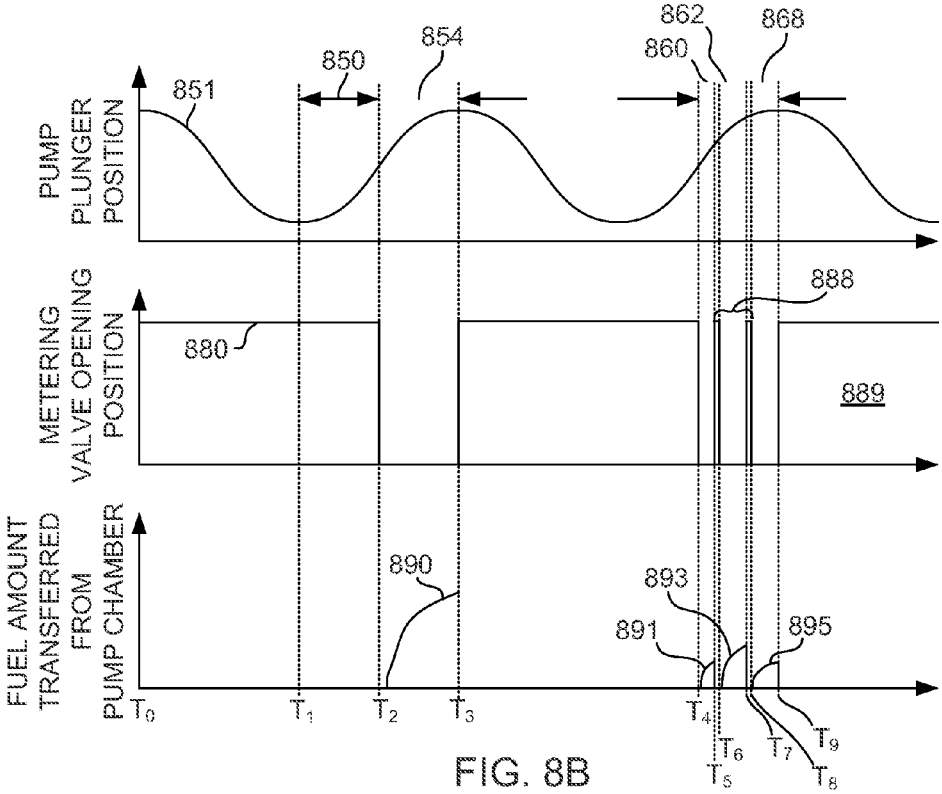

Referring now to FIG. 7A, a cross section of an alternative example high pressure fuel pump 202 and high pressure fuel pump metering valve 220 is shown. The fuel pump and high pressure fuel pump metering valve shown in FIG. 7A may supply fuel to the engine shown in FIG. 1 as part of the fuel system shown in FIG. 2. The fuel pump and high pressure fuel pump metering valve shown in FIG. 7A may be operated according to the method of FIG. 9.

High pressure fuel pump 202 includes a pump plunger 702 and a pump chamber 712. Pump chamber 712 is surrounded by fuel pump housing 740. Fuel may exit fuel pump chamber 712 via fuel pump outlet 706. Fuel pump outlet 706 supplies fuel to an engine fuel rail and fuel injectors. Pump plunger 702 reciprocates in the directions shown at 777. Cam 51 includes lobes 204 that apply force to pump plunger 702 when cam 51 is rotated.

Fuel enters fuel pump 202 via fuel inlet 704 in the direction indicated by the arrows. Fuel passes by fuel volume control plate 738 at passage 735 and through housing passage 717 in the direction shown by the arrows. Similarly, fuel passes by volume control plate 738 at passage 733 and through housing passage 721. Volume control plate 738 is shown in an open position. Volume control plate 738 may be rotated via shaft 708 to selectively open and close metering valve 220. Volume control plate 738 is positioned against housing 740 and acts to seal housing 740 when passages in volume control plate 738 are not aligned with passages 717 and 721 of housing 740.

Shaft 708 may mechanically rotate volume control plate 738 through coupling 737. Fastener 732 retains volume control plate 732 against housing 740 and to shaft 708. Motor 210 may be rotated synchronously with cam 51 and movement of pump plunger 702. Further, the phase of rotation of motor 210 may be adjusted relative to the phase of rotation of cam 51 as shown in FIG. 8A-8B to adjust fuel pressure supplied to the fuel rail.

Figure 7B:
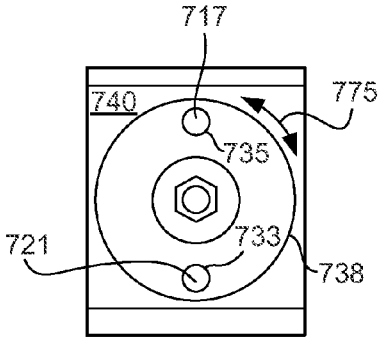

Referring now to FIG. 7B, a section of metering valve 220 indicated by cutting plane 719 of FIG. 7A is shown. Housing 740 includes passages 717 and 721 positioned directly behind passages 735 and 733 which allow fuel to flow into the pumping chamber. Volume control plate 738 may be rotated in either direction shown by arrows 775. Thus, by rotating volume control plate 738 by 90 degrees or less, fuel flow into the fuel pumping chamber may be substantially stopped.

Figure 7C:
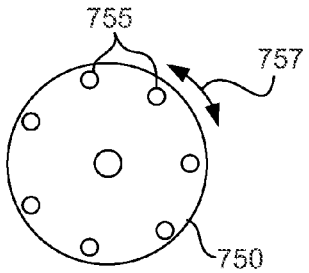

Referring now to FIG. 7C, a front view of an alternative volume control plate is shown. Circular passages 755 are arranged around the periphery of volume control plate 760 such that as volume control plate 760 rotates, fuel may selectively flow into the pumping chamber of the high pressure fuel pump. Volume control plate 750 may rotate in the directions shown by arrows 757. Since circular passages are provided at small angular intervals (e.g., every 50 degrees) fuel flow into pumping chamber 712 can be changed via vary limited rotation by motor 210.

Figure 7D:
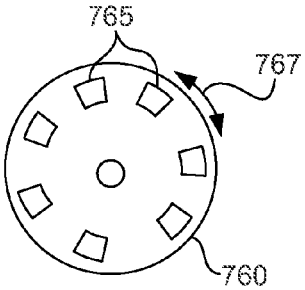

Referring now to FIG. 7D, a front view of an alternative volume control plate is shown. Non-circular passages 765 are arranged around the periphery of volume control plate 760 such that as volume control plate 760 rotates, fuel may selectively flow into the pumping chamber of the high pressure fuel pump. Volume control plate 760 may rotate in the directions shown by arrows 767.

Referring now to FIG. 8A, it shows several plots of interest during operation of high pressure fuel pump 202 and 775 metering valve 220 shown in FIG. 7A. The sequence of FIG. 8A may be performed on the system as shown in FIGS. 1-2 and 7A-D according to the method of FIG. 9. Vertical time markers $T_0$-$T_3$ represent particular times of interest during the sequence. The events shown in one plot at a particular time marker occur at the same time as events in the other plots that align with the same time marker. The plots of FIG. 8A are similar to the plots of FIG. 4A. Therefore, description of similar features and elements are omitted for the sake of brevity. Particular differences are described.

High pressure fuel pump plunger position 801 is shown with a sinusoidal trajectory. The pump plunger extends and retracts into the pump chamber as a camshaft rotates a cam lobe. The high pressure pump suction phase is shown as the region 806. The pumping phase is shown as region 803. During the suction phase, the plunger moves in a direction to increase volume in the pump chamber 712. The pressure in the pump chamber 712 may decrease as the pump chamber volume increases. During the pumping phase, the plunger moves in a direction to decrease volume in the pump chamber. The pressure in the pump chamber 712 may increase as the pump chamber volume decreases.

In this example, at time $T_0$, the pump plunger starts at a higher level and decreases with time such that the high pressure fuel pump is in a suction phase. The high pressure fuel pump metering valve 220 is open during suction phase 806 and no fuel is supplied to the fuel rail. The high pressure fuel pump metering valve position 810 (e.g., position of volume control plate 738) remains in an open state to allow fuel to flow out of the pump chamber 712 as the plunger enters the pumping phase in region 803. The pumping phase begins at time $T_1$. During spill phase in region 802, fuel in pump chamber 712 flows out since metering valve 220 is in an open state and since the volume of pump chamber 712 is decreasing.

At time $T_2$, the metering valve closes as indicated by the metering valve opening position transitioning to zero. Since high pressure fuel pump metering valve 220 rotates in this example, the position of high pressure fuel pump metering valve 220 can change quickly to adjust flow into the pump chamber. Additionally, the volume control plate rotates without impacting the fuel pump housing. Further, fuel may operate as a lubricant between pump housing 740 and volume control plate 738 as shown in FIG. 7A. In this way, valve closing noise may be reduced. The spill phase in region 802 is ended and the output phase in region 804 begins in response to closing the high pressure fuel pump metering valve 220. Fuel exits high pressure fuel pump 202 during the output phase when fuel pressure in pump chamber 712 increases above fuel pressure in the fuel rail. The amount of fuel output is shown at 814 and is relatively small as the metering valve is closed late in the pumping phase.

The amount of fuel pumped and the fuel pressure provided to the fuel rail may be increased by advancing the high pressure fuel pump metering valve closing timing during the pumping phase. The amount of fuel pumped and the fuel pressure provided to the fuel rail may be decreased by retarding the high pressure fuel pump metering valve closing timing during the pumping phase. The high pressure fuel pump metering valve closing is advanced when the metering valve is closed earlier in the pumping phase. The high pressure fuel pump metering valve closing is retarded when the high pressure fuel pump metering valve is closed later in the pumping phase.

Referring now to FIG. 8B, a second operating sequence of high pressure fuel pump 202 and high pressure fuel pump metering valve 220 shown in FIG. 7*a* is provided. The sequence of FIG. 8B may be performed on the system as shown in FIGS. 1-2 and 7A-D according to the method of FIG. 9. The plots of FIG. 8B are similar to the plots of FIG. 4A. Therefore, description of similar features and elements are omitted for the sake of brevity. Particular differences are described.

At time $T_0$, the high pressure fuel pump plunger position 851 is decreasing indicating that the high pressure fuel pump is in a suction phase. The high pressure fuel pump metering valve position 880 is shown open position to allow fuel to flow into the high pressure fuel pump chamber 712. No fuel is transferred from the high pressure fuel pump to the fuel rail.

At time $T_1$, the high pressure fuel pump plunger position begins the pumping phase which extends from time $T_1$ to time $T_3$. The high pressure fuel pump metering valve is open from time $T_1$ to time $T_2$. Therefore, the high pressure fuel pump is in a spill phase in region 850. The high pressure fuel pump metering valve closes at time $T_2$ and plunger 702 begins to pressurize fuel in pump chamber 712. The high pressure fuel pump is in an output phase between times $T_2$ and $T_3$ as indicated by region 854. It should be noted that high pressure fuel pump metering valve 220 begins to close at time $T_2$ which is advanced of the metering valve closing time illustrated in FIG. 8A. Thus, a larger volume of pump chamber 712 is displaced after high pressure fuel pump metering valve closing timing shown in FIG. 8B between time $T_2$ and time $T_3$ as compared to that shown between time $T_2$ and time $T_3$ in FIG. 8A. Further, time $T_2$ in FIG. 8B is advanced as compared to time $T_2$ in FIG. 8A. As a result, the fuel amount transferred from the high pressure fuel pump increases as shown at 890.

After time $T_3$, the high pressure fuel pump enters a suction phase once again and then enters a pumping phase as the plunger position transitions from decreasing to increasing. At time $T_4$, the high pressure fuel pump metering valve is closed and fuel pressure in the pump chamber begins to increase in region 860. Fuel exits the fuel pump and flows into the fuel rail when pressure in the fuel pump exceeds fuel pressure in the fuel rail. The high pressure fuel pump metering valve opens again at time $T_5$ and fuel flows out of the pump chamber and back toward the fuel pump inlet relieving fuel pressure in the fuel pump. The high pressure fuel pump metering valve is closed once again at time $T_6$ and fuel pressure in the fuel pump begins to increase again until the high pressure fuel pump metering valve is opened again at time $T_7$. Thus, fuel pressure increases in region 862 and fuel may be output to the fuel rail when fuel pressure in the fuel pump increases to a level above pressure in the engine fuel rail. At time $T_8$, the high pressure fuel pump metering valve closes for a third time during the pumping phase of the high pressure fuel pump in region 868. Pressure in the fuel pump increases as the fuel in the fuel pump is compressed. Finally, at time $T_9$ the metering valve is opened as the high pressure fuel pump enters a suction phase and exits the pumping phase.

Region 860 shows a first rate of fuel compression, region 862 shows a second rate of fuel compression, and region 868 shows a third rate of fuel compression. The rates of fuel compression can be visually represented by the pump plunger position in regions 860, 862, and 868. The fuel amount at 891 represents the amount of fuel pumped in region 850. The amount of fuel at 893 represents the amount of fuel pumped in region 862. The amount of fuel at 895 represents the amount of fuel pumped in region 868. For example, in region 860 the pump plunger moves more vertically for a given camshaft rotation interval (e.g., 10 cam degrees) as compared to plunger motion in regions 862 and 868. Accordingly, the amount of fuel output by the high pressure fuel pump may be increased different amounts in different regions of the pumping cycle. Further, the high pressure fuel pump metering valve may be repeatedly opened and closed as shown between time $T_4$ and time $T_9$ in response to pressure in the fuel rail. For example, if pressure in the fuel rail increases above a desired pressure, the high pressure fuel pump metering valve may be opened to limit the pressure rise in the fuel rail. If pressure in the fuel rail is less than desired, the high pressure fuel pump metering valve may be closed to increase pressure in the fuel rail. The volume control plates shown in FIGS. 7A-7D allow fuel flow into the fuel pump chamber to be interrupted a plurality of times when motor 210 rotates only a single revolution. Consequently, the volume control plates shown in FIGS. 7A-7D may be useful to reduce the rotation rate of motor 210.

Figure 9:
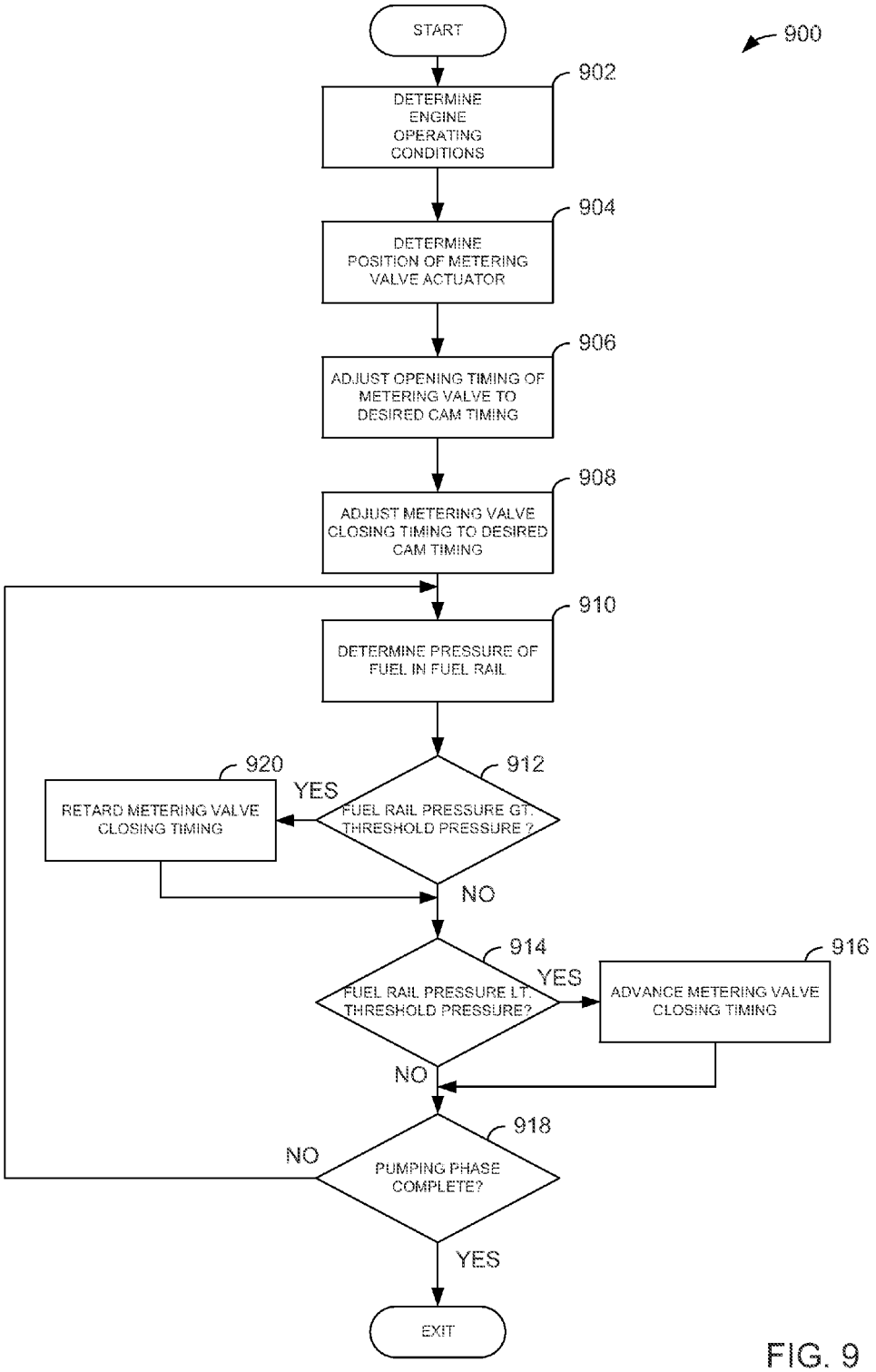
FIG. 9 shows an example flowchart of a method for operating a fuel pump and metering valve.

Referring now to FIG. 9, an example flowchart of a method for operating a fuel pump and high pressure fuel pump metering valve is shown. The method of FIG. 9 may be stored as instructions in non-transitory media in the system of FIGS. 1-8B. The method of FIG. 9 may be executed each high pressure pump cycle.

At 902, method 900 determines engine operating conditions. Engine operating conditions may include but are not limited to engine camshaft position, engine load, engine crankshaft position, fuel rail fuel pressure, and engine temperature. Method 900 proceeds to 904 after engine operating conditions are determined.

At 904, method 900 determines a position of a high pressure fuel pump metering valve actuator. In one example, where the high pressure fuel pump metering valve actuator is a motor, the high pressure fuel pump metering valve motor position may be determined via output of an encoder that is coupled to the motor. Further, a position of an engine cam may be determined at 904 via a camshaft position sensor. The camshaft position and the metering valve actuator position may be determined substantially simultaneously so that high pressure fuel pump metering valve actuator position is determined relative to camshaft position. Method 900 proceeds to 906 after position of the high pressure fuel pump metering valve actuator is determined.

At 906, method 900 adjusts opening timing of the high pressure fuel pump metering valve to a desired cam timing. For example, the high pressure fuel pump metering valve opening time may be adjusted to a location where the pump plunger has reached a peak stroke position where volume in the high pressure pump chamber is at a minimum (See FIGS. 4A-B, 6A-B, 8A-B the beginning of the high pressure suction stroke). In one example, the rotational speed of a motor actuating the high pressure pump metering valve may be briefly increased or decreased relative to camshaft rotation to adjust the opening time of the high pressure fuel pump metering valve relative to the position of the high pressure pump plunger. Since the high pressure pump plunger is driven by the camshaft, adjusting the high pressure fuel pump metering valve opening position relative to the camshaft position adjusts the high pressure fuel pump metering valve opening timing relative to the position of the high pressure pump plunger. In some examples, the high pressure fuel pump metering valve is rotated synchronously with camshaft rotation. Method 900 proceeds to 908 after opening timing of the high pressure fuel pump metering valve is adjusted.

At 908, method 900 adjusts high pressure fuel pump metering valve closing timing to a desired camshaft timing. For example, as illustrated in FIGS. 4A-B, 6A-B, and 8A-B, high pressure fuel pump metering valve closing timing may be advanced or retarded relative to camshaft timing to increase or decrease pressure in the high pressure fuel pump. In one example, the current and/or voltage supplied to motor windings may be increased or decreased during a rotational cycle of a camshaft to adjust high pressure fuel pump metering valve opening and closing timings relative to high pressure pump plunger position. Thus, during and between a cam rotation cycles, speed of a motor opening and closing a high pressure fuel pump metering valve may be increased and/or decreased to adjust metering valve opening and closing times. The motor operating the metering valve may be operated synchronously with camshaft rotation. Method 900 proceeds to 910 after metering valve closing timing is adjusted to a desired cam timing.

At 910, method 900 determines pressure in a fuel rail supplying fuel injectors with fuel. In one example, fuel pressure in a fuel rail may be determined via a fuel rail fuel pressure sensor. Method 900 proceeds to 912 after pressure of fuel in a fuel rail supplying fuel to fuel injectors is determined.

At 912, method 900 judges whether or not fuel rail pressure is greater than a threshold pressure. If so, method 900 proceeds to 920. Otherwise, method 900 proceeds to 914. In one example, method 900 monitors fuel pressure in the fuel rail during both the suction and pumping phases of a high pressure pump. If pressure in the fuel rail is greater than a threshold level when the high pressure fuel pump is in the suction phase, the metering valve may be held open. If the pressure in the fuel rail is greater than the threshold level during the pumping phase, the metering valve may be commanded to an open position for the remaining portion of the pumping phase or at least until fuel pressure is less than the desired fuel pressure. In other examples, the high pressure fuel pump metering valve closing timing may be retarded so as to reduce the output of the high pressure fuel pump.

At 920, method 900 revises high pressure fuel pump metering valve closing timing such that the high pressure fuel pump metering valve stays open for a longer period of time during the pumping portion of the high pressure fuel pump cycle. Thus, the high pressure fuel pump metering valve closing timing may be retarded. In some examples, the high pressure fuel pump metering valve closing timing may be retarded relative to camshaft or high pressure pump plunger position such that the high pressure fuel pump metering valve remains open for one or more high pressure fuel pumping cycles. In this way, an amount of fuel pumped by the high pressure pump into the fuel rail may be decreased so as to maintain or decrease fuel rail fuel pressure. Method 900 proceeds to 914 after opening timing of the fuel metering valve is adjusted.

At 914, method 900 judges whether or not fuel rail pressure is less than a threshold pressure. If so, method 900 proceeds to 916. Otherwise, method 900 proceeds to 918. Thus, if fuel pressure in the fuel rail is within a desired range the timing of the high pressure fuel pump metering valve is not adjusted. However, if fuel pressure in the fuel rail is above or below the desired range, closing timing of the high pressure fuel pump metering valve may be adjusted.

At 916, the high pressure fuel pump metering valve may be commanded to a closed position in response to fuel pressure in the fuel rail being less than a desired pressure. Thus, if the pressure in the fuel rail is less than the threshold level during the pumping phase, the high pressure fuel pump metering valve may be commanded to a closed position for the remaining portion of the pumping phase or at least until fuel pressure is greater than the desired fuel pressure. High pressure fuel pump output may be increased via advancing high pressure fuel pump metering valve closing timing relative to camshaft or high pressure pump plunger position. If the high pressure fuel pump metering valve is already closed, the high pressure fuel pump metering valve closing time for a subsequent high pressure pump cycle can be advanced in time to increase the output of the high pressure pump.

In some examples, two fuel rail pressure threshold levels may be provided for controlling fuel pump metering valve closing timing. In one example, when fuel pressure within a fuel rail is less than the first threshold value, the fuel pump metering valve closing timing is advanced to increase high pressure fuel pump output. If fuel pressure in the fuel rail exceeds a second threshold level, high pressure fuel pump metering valve closing timing may be retarded to lower the pressure of fuel in the fuel rail. In this way, fuel pressure in a fuel rail may be controlled between an upper fuel pressure and a lower fuel pressure. Method 900 proceeds to 918 after high pressure fuel pump metering valve position is advanced to increase high pressure fuel pump output.

At 918, method 900 judges whether or not the pumping phase of a high pressure fuel pump is complete. In one example, a high pressure fuel pump cycle may be a time between beginning a first suction phase and beginning of a second suction phase. Thus, the end of a pumping phase indicates a new high pressure fuel pump cycle is underway. If the pumping phase of a high pressure fuel pump is not complete, method 900 returns to 910.

Thus, between 910 and 918 the high pressure fuel pump metering valve position opening and closing timing can be adjusted in response to pressure of fuel in the fuel rail. FIGS. 4B and 8B show two examples where the metering valve is opened and closed multiple times during a cycle of the high pressure pump in response to pressure of fuel in a fuel rail.

As will be appreciated by one of ordinary skill in the art, methods described in FIG. 9 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A fuel system, comprising:

a fuel pump including an inlet, an outlet, a first rotatable cam, and a plunger reciprocatable via the first rotatable cam;

a fuel injector in fluidic communication with the outlet;

a metering valve positioned at the inlet of the fuel pump, the metering valve including a second rotatable cam mechanically coupled to a rotatable motor, an encoder mechanically coupled to the motor, where the metering valve further comprises a valve seat and a valve disk, the valve disk coupled to a pump housing via a portion of the pump housing that forms a C shaped fuel passage; and a controller including executable instructions stored in non-transitory memory to determine a position of the rotatable motor via the encoder and to rotate the rotatable motor synchronous with rotation of the first rotatable cam.

2. The fuel system of claim 1, where the metering valve further comprises a return spring positioned to close the valve disk against the valve seat, the return spring positioned between the valve disk and the C shaped fuel passage, the return spring contacting the valve disk and a center portion of the C shaped fuel passage.

3. The fuel system of claim 2, where the valve disk is coupled to a shaft.

4. The fuel system of claim 3, where the second rotatable cam is in mechanical communication with the shaft via a tappet, the tappet including a spring.

5. The fuel system of claim 4, further comprising a sealing ring, the sealing ring in mechanical communication with the shaft, and further instructions to adjust opening time of the metering valve via decreasing motor speed relative to camshaft rotation.

6. The fuel system of claim 1, further comprising a check valve, the check valve positioned at the outlet and biased to prevent fuel flow into the outlet.

7. A fuel system, comprising:

a fuel pump including an inlet, an outlet, a first rotatable cam, and a plunger reciprocatable via the first rotatable cam;

a fuel injector in fluidic communication with the outlet;

a metering valve positioned at the inlet of the fuel pump, the metering valve including a second rotatable cam in mechanical communication with a tappet, the metering valve further including a valve seat and a valve disk, the valve disk coupled to a pump housing via a portion of the pump housing that forms a C shaped fuel passage;

a rotatable motor in mechanical communication with an encoder and the second rotatable cam via a coupling; and a controller including executable instructions stored in non-transitory memory to rotate the rotatable motor synchronous with the first rotatable cam.

8. The fuel system of claim 7, further comprising additional instructions to determine a position of a metering valve actuator via the encoder.

9. The fuel system of claim 7, where the rotatable motor includes a motor shaft, and where the motor shaft is perpendicular to an axis of motion of the valve disk, and where the motor shaft is coupled to the second rotatable cam.

10. The fuel system of claim 7, where the valve disk is away from the valve seat when the metering valve is in an open position, and where the valve disk is in contact with the valve seat when the metering valve is in a closed position.

11. The fuel system of claim 7, further comprising a first spring, and where the first spring is in mechanical communication with the valve disk and a center portion of the C shaped fuel passage, and where the tappet includes a second spring.

12. The fuel system of claim 11, where the first spring is biased to close the valve disk against the valve seat.

13. A fuel system, comprising:

a fuel pump including an inlet, an outlet, a first rotatable cam, and a plunger reciprocatable via the first rotatable cam;

a fuel injector in fluidic communication with the outlet;

a metering valve positioned at the inlet of the fuel pump, the metering valve including a second rotatable cam in communication with a tappet and a valve disk, where the valve disk is coupled to a pump housing via a portion of the pump housing that forms a C shaped fuel passage, and where a return spring contacts the valve disk and a center portion of the C shaped fuel passage;

a rotatable motor in mechanical communication with the second rotatable cam via a coupling; and a controller including executable instructions stored in non-transitory memory for synchronously rotating the second rotatable cam with the first rotatable cam via the rotatable motor.

14. The fuel system of claim 13, where the controller includes further instructions, the instructions providing for opening the metering valve when the plunger is substantially at a maximum plunger lift level and determining metering valve position based on an encoder.

15. The fuel system of claim 14, where the controller includes further instructions to adjust closing timing of the metering valve in response to engine load.

16. The fuel system of claim 15, where the controller includes further instructions to vary an opening time of the plunger to adjust an amount of fuel transferred from the fuel pump.

17. The fuel system of claim 14, where the controller includes further instructions to adjust an amount of fuel output from the fuel pump.

18. The fuel system of claim 14, where the controller includes further instructions to rotate the rotatable motor in response to fuel pressure in a fuel rail.

* * * * *